US006244088B1

(12) United States Patent
Compton

(10) Patent No.: US 6,244,088 B1
(45) Date of Patent: Jun. 12, 2001

(54) RIDGE ROLLING TOOL FOR PIPES

(76) Inventor: Douglas C. Compton, 109 Broad St., Headland, AL (US) 36345

( * ) Notice: Subject to any disclaimer, the term of this patent is extended or adjusted under 35 U.S.C. 154(b) by 0 days.

(21) Appl. No.: 09/377,418

(22) Filed: Aug. 20, 1999

(51) Int. Cl.[7] ..... B21D 17/04
(52) U.S. Cl. ..... 72/105; 470/67
(58) Field of Search ..... 72/70, 105, 106; 470/67, 69, 70

(56) References Cited

U.S. PATENT DOCUMENTS

| | | | | |
|---|---|---|---|---|
| 718,830 | | 1/1903 | Doolittle . | |
| 2,809,687 | | 10/1957 | Ogle . | |
| 2,975,819 | | 3/1961 | Costanzo et al. . | |
| 3,002,205 | * | 10/1961 | Buyer | 470/67 |
| 3,015,502 | | 1/1962 | Frost et al. . | |
| 3,541,826 | | 11/1970 | Halliburton . | |
| 3,903,722 | | 9/1975 | Thau, Jr. . | |
| 4,041,747 | | 8/1977 | Elkin . | |
| 4,114,414 | | 9/1978 | Goodman . | |
| 4,144,733 | | 3/1979 | Whitten . | |
| 4,606,249 | * | 8/1986 | Hayes et al. | 470/69 |
| 4,790,166 | | 12/1988 | Kaar . | |
| 4,825,676 | | 5/1989 | Diggins . | |
| 5,079,940 | | 1/1992 | Pulver et al. . | |
| 5,285,576 | | 2/1994 | Taylor . | |
| 5,528,919 | | 6/1996 | McGrady et al. . | |

FOREIGN PATENT DOCUMENTS

| | | | | |
|---|---|---|---|---|
| 1 213 202 | * | 3/1966 | (DE) | 470/69 |

* cited by examiner

*Primary Examiner*—Lowell A. Larson
(74) *Attorney, Agent, or Firm*—Siemens Patent Services, LC

(57) ABSTRACT

A roller tool for forming an outwardly projecting ridge in a pipe, which tool is usable with the chuck or power head of a conventional pipe working machine, and a carriage suitable for mounting the roller tool and other tools on the pipe working machine. The roller tool has a female roller rotatably supported on a movable frame. The frame is fixed to the carriage, which in turn is pivotally mountable on the carriage supporting rails of the pipe working machine. One rail is fully encircled by a closed socket formed in the carriage, so that the roller tool cannot spontaneously disengage from the host pipe working machine. The other rail is partially encircled by an open socket formed in the carriage. The roller tool can pivot about the closed socket between an operational position and a standby position enabling the grooving machine to be utilized for grooving with the roller tool still attached. The roller tool has plural female rollers configured differently to provide ability to form the ridge at different distances from the end of the pipe being worked. In an alternative embodiment, conventional pipe working tools are used with the novel carriage.

8 Claims, 7 Drawing Sheets

RIDGE ROLLING TOOL FOR PIPES

BACKGROUND OF THE INVENTION

1. Field of the Invention

The present invention relates to tools for working tubular conduits or pipes, and more particularly to a tool which forms an outwardly projecting ridge in pipes. The tool is employed in fabrication applications wherein purely tubular stock must be modified to include a ridge. Pipes which are intended to be assembled to form fluid conducting assemblies which are to receive fittings which rely on interference with the their associated pipes are afforded such interference by a ridge formed by the novel tool. The novel tool finds application in the fields of construction of plumbing systems, fire sprinkler systems, heating and cooling piping systems, and other residential, industrial, commercial, military, and institutional construction projects wherein interference based fittings are to be incorporated and tubular stock piping is utilized.

2. Description of the Prior Art

Buildings greater than those for single family residences may have involved piping systems wherein pipes extend along ceilings and floors quite extensively. A principal example is that of fire sprinkler systems, which may be either wet or dry. During construction of typical commercial, multi-unit residential, multi-use, institutional, industrial, and military buildings, fire sprinkler systems are installed after the structural elements of the building are erected, and prior to finishing the building. For example, a sprinkler system is assembled prior to installation of dropped ceilings.

Fabrication of a sprinkler system or other large scale fluid distribution system is difficult since pipe is ordinarily furnished in awkward lengths that are not easily maneuvered into place. In a typical building, sprinkler and other piping systems must compete for space with electrical components, duct work for heating, ventilation, and air conditioning (HVAC) systems, structural elements which may project from floor slabs, ceilings, and columns, communications cables, and other architectural or functional features. A mechanic fitting pipes together may find that access, if not completely obstructed, is limited. This situation is frequently encountered in commercial construction projects.

One development which addresses this difficulty is that of utilizing fittings and connectors which are slipped axially over exposed ends of pipe, then locked to the pipe. An example is seen in Application Ser. No. 08/984,045, now U.S. Pat. No. 6,056,330, filed Dec. 3, 1997 by the present inventor and James R. Drury, a co-inventor of the aforementioned application. The filed application is directed to axially clamping pipe couplers of the type which require an outwardly projecting ridge formed in a pipe receiving a coupler. This application is hereby incorporated by reference.

Pipe may have an outwardly projecting ridge (hereinafter referred to as "ridge") formed therein by a suitable rolling tool of the type more typically employed to form an inwardly projecting groove. Tools for forming a ridge by rolling a pipe are known. Examples are seen in U.S. Pat. No. 2,809,687, issued to William Jackson Ogle on Oct. 15, 1957, and U.S. Pat. No. 4,790,166, issued to Richard A. Kaar on Dec. 13, 1988. These prior art devices are self-contained tools none of which is adapted to form a readily deployed accessory mounted on a pipe working machine. By contrast, the present invention provides a carriage configured to enable the ridge forming accessory to be readily swung out of the way to allow other pipe working operations to proceed when desired.

U.S. Pat. No. 718,830, issued to William W. Doolittle on Jan. 20, 1903, sets forth a pipe truing device which operates by rolling pipe against rollers. However, unlike the present invention, the rollers are not disposed to be able to form a ridge in the pipe in the manner of the present invention. Also, the device of Doolittle is not readily mounted on a multipurpose, powered pipe working machine, as is the present invention.

Prior art tools which are pivotally mounted on support rails of the powered chuck of a multipurpose pipe working machine are known, as exemplified by U.S. Pat. No. 5,079,940, issued to Dale A. Pulver et al. on Jan. 14, 1992. However, the tool of Pulver et al. does not form an outwardly projecting ridge in the manner of the present invention, and also only loosely engages its host machine, whereas the present invention allows for secure retention on the host machine. Notably, the tool of Pulver et al. cannot be retained on the host machine in a standby position, as can the present invention.

None of the above inventions and patents, taken either singly or in combination, is seen to describe the instant invention as claimed.

SUMMARY OF THE INVENTION

The present invention provides a carriage pipe working tool usable with host conventional multipurpose powered pipe working machines. A significant benefit of the novel carriage is that once installed on the pipe working machine, it requires no dismantling of the pipe working machine either to be utilized, nor dismantling or assembly of the pipe working machine to resume grooving work. The novel carriage is merely swung between the operational and idle positions. A tool mounted thereon is removably retained on the pipe working machine even in the standby position, and avoids inadvertent disengagement from its host machine and possible loss and damage. It is therefore quite practical to alternate among various pipe forming operations, such as forming ridges and forming grooves, cutting threads, and deburring.

One application is a ridge forming machine which forms suitable ridges in a pipe so that axially clamped couplers of the type described in co-pending application Ser. No. 08/984,045 may be readily employed to assemble piping systems. The novel ridge forming machine operates by rolling a pipe or any tubular conduit between two rollers. The novel machine cooperates with a conventional pipe working machine, which pipe working machine supports the novel ridge forming machine and also rotates a pipe or similar work piece.

The novel ridge forming machine utilizes rollers, or rotary dies, similar in principal to those employed to form grooves. However, the rollers are arranged such that the ridge produced thereby is the opposite of a groove, in that the ridge projects outwardly from the pipe. The rollers determine the distance between the end of the pipe and the ridge formed thereon. A plurality of female rollers are provided, each differing from the others in length. This feature enables the ridge to be formed at different distances from the end of the pipe.

The novel machine has gripping elements for mounting on dual parallel support shafts present on the conventional pipe working machine for supporting conventional pipe working apparatus. The gripping elements are configured to enable the novel ridge forming machine to be swung between an operational position and an idle or standby position on the pipe working machine. In the operational position, pipe inserted into the chuck of the pipe working machine may be worked to form a ridge. In the standby position, the ridge forming machines rests out of the way of other pipe working tools, and thus permits other aspects of pipe forming work to proceed.

A major benefit of the ridge forming machine is that expense, bulk, weight, and complexity of equipment are minimized. A multipurpose pipe working machine is frequently available on any job site requiring significant piping work, and thus is also available for adaptation for ridge forming. Therefore, providing an entire machine including a powered chuck, as seen in the patents to Ogle and Kaar, is not necessary.

Therefore, a ridge forming machine may be provided which includes only the roller apparatus forming the ridge, and an adapter for mounting the ridge forming machine on a conventional pipe working machine. Rotation of the pipe being worked is accomplished by a conventional host pipe working machine. The ridge forming machine produces highly satisfactory results on pipes made from materials ranging from steel to polyvinyl chloride (PVC).

Accordingly, it is a principal object of the invention to provide a carriage for pipe working tools which swings between an operational position and a standby position.

It is another object of the invention to cooperate with a conventional pipe working machine so as to utilize the powered chuck of the pipe working machine when working pipe or tubular conduit.

It is a further object of the invention that the novel carriage be directly mounted on support apparatus of the pipe working machine, and be readily installed thereon without tools.

A further object of the invention is that pipe working tools be removably retained on the pipe working machine.

Another object of the invention is to provide a roller machine which forms outwardly projecting ridges in pipe and tubular conduits.

An additional object of the invention is that the ridge forming machine predetermine the distance between the end of the pipe and the ridge formed thereon.

Yet another object of the invention is that the ridge forming machine be simple, light weight, and compact.

Still another object of the invention is to enable the ridge to be formed selectively at any one of several different distances from the end of the pipe.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

The novel pipe tool carriage of the present invention is adaptable to most known pipe working tools of a conventional powered, multipurpose host machine. Description of the novel carriage will proceed with reference to a novel pipe working tool which is used in the manner of other known pipe working tools.

Figure 1:
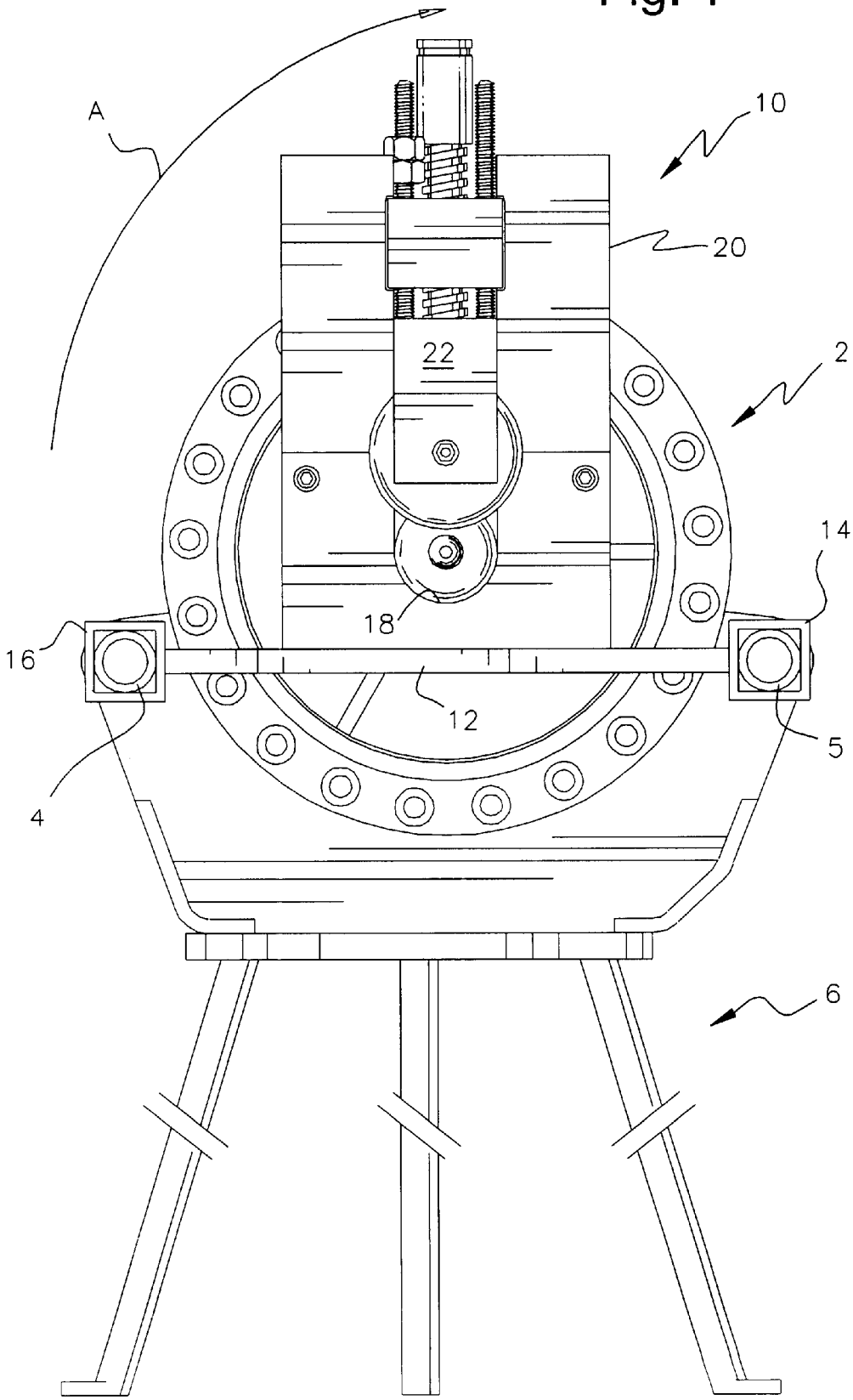
FIG. 1 is an environmental, front perspective view of the invention, depicting an operational position of the novel tool carriage which supports a female roller, and wherein a complementing male roller is omitted from the view.
Figure 2:
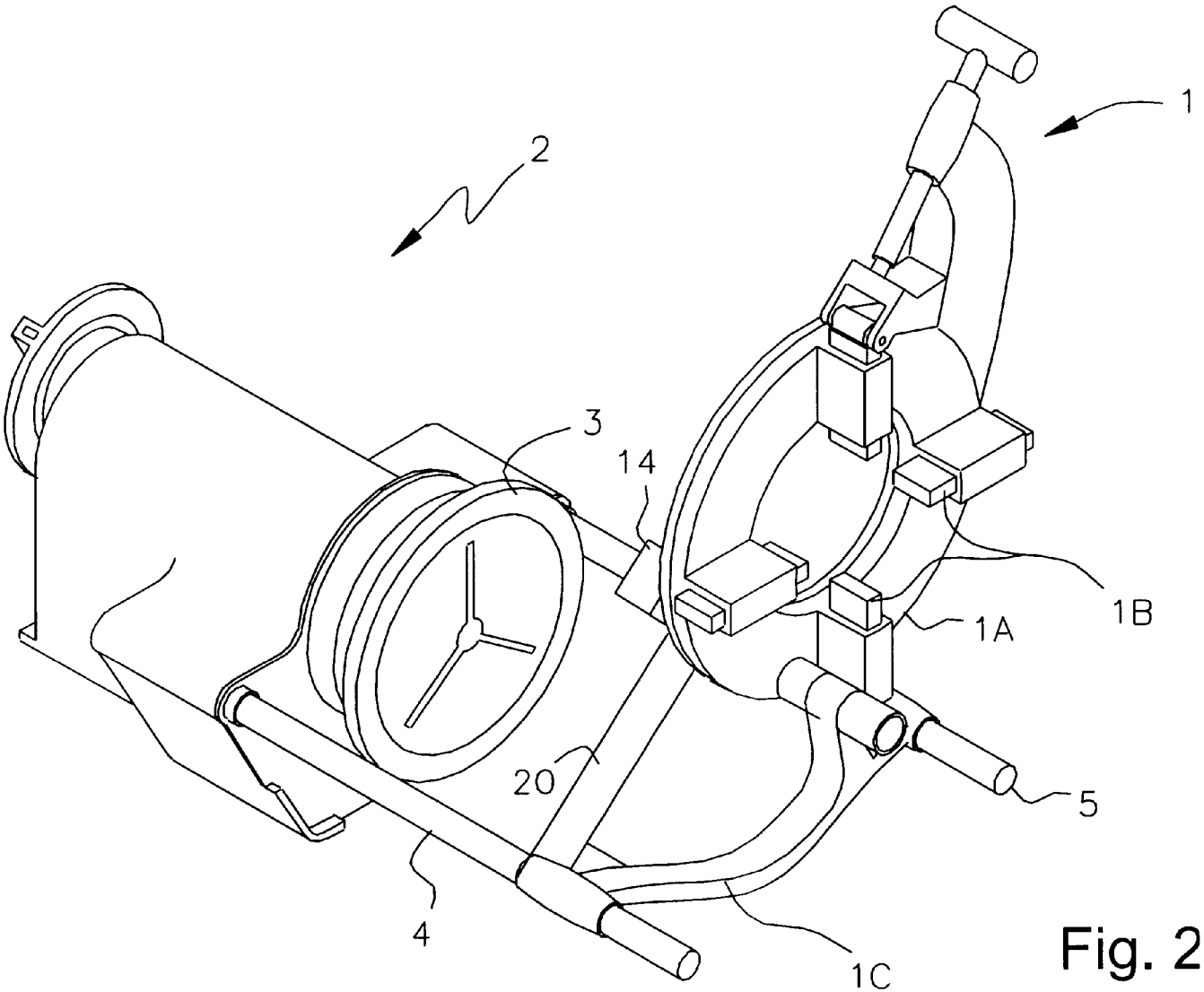
FIG. 2 is a diagrammatic, perspective view of a conventional host machine with which the novel machine cooperates.

The novel ridge forming machine of the present invention is employed to form an outwardly projecting ridge along the circumference on the wall of a pipe. Machine 10 is usable with a conventional pipe working drive machine 2 (shown in broken lines) for working pipes, and is shown in FIG. 1 mounted to machine 2. Turning momentarily to FIG. 2, drive machine 2 is seen to have a chuck 3 for gripping and rotating pipe (not shown in FIG. 2), and two carriage supporting rails 4, 5. Chuck 3 is disposed on machine 2 such that its axis of rotation is parallel to rails 4, 5. Machine 2 is self-contained, having a suitable source of power and appropriate controls (neither shown). Machine 2 enables any type of pipe working requiring rotation of pipe. Illustratively, a conventional thread cutting tool 1 is shown mounted on rails 4, 5 of machine 2. Tool 1 includes a frame 1A, working elements 1B, and a carriage 1C.

In the example of tool 1, working elements 1B are thread cutting blades. In other tools, working elements may be grinding and polishing apparatus for deburring and similar operations, rollers for roller forming, burnishing, and similar operations, or any other tool elements that contact and modify characteristics of a pipe being worked. The frame is the structural portion of the tool which holds the working elements in appropriate position to operably engage the pipe or other work piece. Carriage 1C has two sockets 1D which stably engage rails 4, 5 of drive machine 2 by slipping over rails 4, 5 and sliding linearly therealong. Carriage 1C is locked in a selected location on rails 4, 5 in any suitable way. Machine 2 and tool 1 are of any well known type, such as the products of Berkley Tool and Rigid Tool Company.

Returning to FIG. 1, machine 2 is shown mounted on a tripod work stand 6 (shown in broken lines) by bolts 7, and can be transported to a job site to enable pipe to be worked on site. Machine 10 and other pipe working tools (such as thread cutting tool 1 of FIG. 2) may be mounted to machine 2 on the job site. A further example of a conventional tool is a grooving tool (not shown) is described in U.S. Pat. No. 4,144,733, issued to Billy L. Whitten on Mar. 20, 1979, which patent is incorporated herein by reference.

Machine 10 engages carriage supporting rails 4, 5 by a carriage 12 having a closed socket 14 disposed at one end of carriage 12, and an open socket 16 disposed at the opposite end of carriage 12. Socket 14 is closed in that it fully encircles rail 5, enabling carriage 12 and all components fixed to carriage 12 to pivot about rail 5, as indicated by arrow A. Socket 16 is open at the bottom, as seen in FIG. 1, thereby being able to swing away from rail 4 when machine 10 is pivoted about rail 5. To summarize essential components of carriage 12, there is a first socket 14 having a receptacle which includes a wall enclosing the receptacle, which wall is fully closed and continuous along its circumference. Distance between opposing walls of socket 14 is such that socket 14 encircles and closely cooperates with the carriage supporting rail so that machine 10 will be securely mounted on machine 2. Second socket 16 is dimensioned and configured to slip radially over and partially encircle the second carriage supporting rail 4, so that only one socket need be maneuvered onto a rail. Requiring that two sockets be maneuvered into place simultaneously is not necessary.

As shown in FIG. 1, machine 10 is stably and securely supported on rails 5, 6, and is in an operational position for working pipe. Machine 10 is installed on machine 2 by slipping closed socket 14 over rail 5 when socket 14 and rail 5 are in axial alignment, and sliding machine 10 towards chuck 3. Machine 10 is then pivoted in a direction opposite that of arrow A until open socket 16 comes to rest on rail 4. Sockets 14, 16 are dimensioned and configured to constrain carriage 12 and components attached thereto from full disengagement from machine 2 by moving in any direction other than sliding axially along rails 4, 5.

Figure 3:
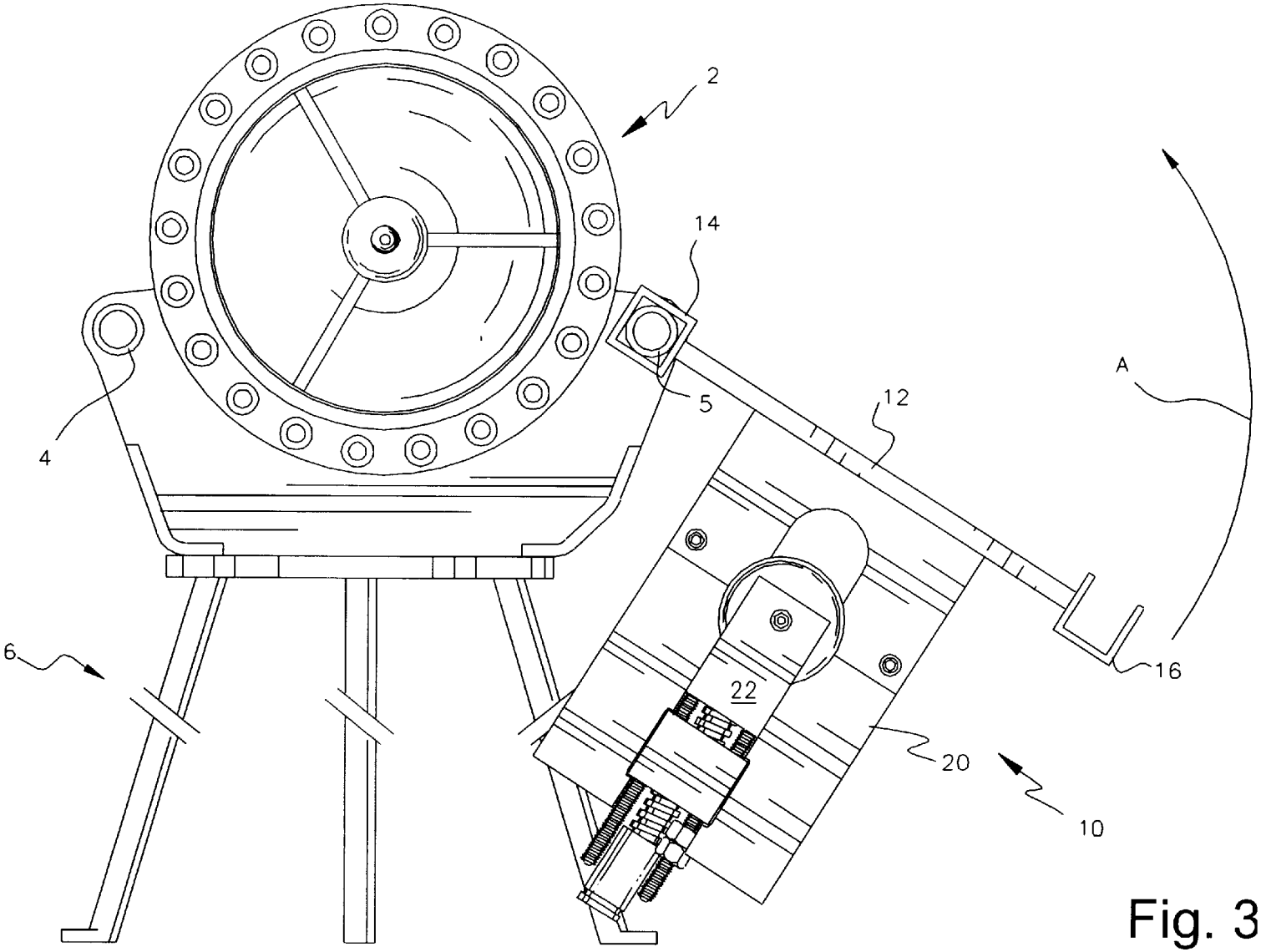
FIG. 3 is an environmental, front perspective view similar to FIG. 1, depicting a standby position of the female roller and its supporting frame.

Machine 10 is shown in a standby position, relative to machine 2, in FIG. 3. In the standby position, machine 10 is retained on machine 2, albeit in a location away from chuck 3. In the standby position, machine 10 is readily accessible for deployment by pivoting machine 10 in the direction indicated by arrow B, but leaves chuck 3 accessible so that cutting, deburring, threading, and grooving machines or tools (not shown) may be used with machine 2. This is possible because rails 4, 5 project forwardly of chuck 3 sufficiently as to accommodate more than one tool. It may be necessary to provide rails 4, 5 of a length greater than that originally furnished to accommodate plural carriages.

Figure 4:
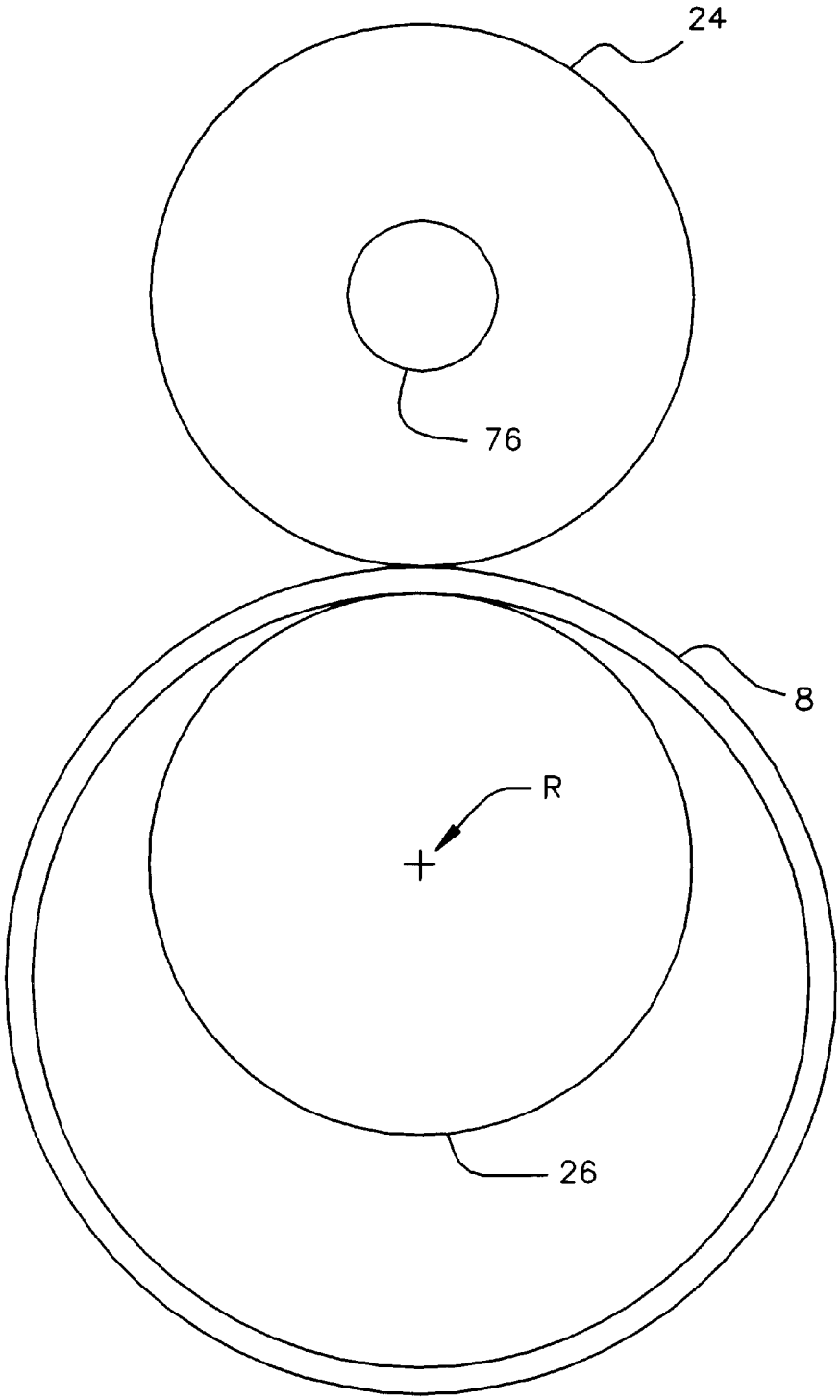
FIG. 4 is an environmental diagrammatic detail view showing engagement of the female roller of FIG. 1, the male roller omitted from FIG. 1, and a pipe shown in its initial position prior to forming a ridge therein, with pipe diameter exaggerated for understanding.

Machine 10 includes a sturdy housing or frame 20 fixed to carriage 12. Frame 20 supports a tool holder 22 slidably carried thereon. Tool holder 22 is vertically movable along frame 20 is shown in FIG. 1, so that it may be moved towards and away from the axis of rotation of chuck 3. An exemplary range of travel of tool holder 22 is shown with the lowermost position shown in solid lines, and the uppermost position shown in broken lines. An opening 18 affording access to chuck 3 is revealed when tool holder 22 is adjusted upwardly from the position shown in broken lines. Movable mounting of tool holder 22 on frame 20 is accomplished in any suitable way. For example, tool holder 22 may be supported on vertically oriented guide rails (not shown) fixed within frame 20. Referring also to FIG. 4, tool holder 22 carries a female roller 24 which is brought to bear on a pipe 8 in which a ridge (not shown) is to be formed. Female roller 24 is rotatably mountable on tool holder 22 in an orientation parallel to the axis of rotation of chuck 3. It follows that female roller 24 moves away from the axis of rotation of the chuck when machine 10 is moved from the operational position of FIG. 1 to the standby position of FIG. 2.

A complementing male roller 26 is installed in chuck 3 (See FIG. 1). The end elevational view of FIG. 4 shows rollers 24, 26 and pipe 8 in their initial relative positions, as they would be attached to machines 2 and 10. Rollers 24, 26 are essentially similar to rollers for forming grooves, but are reversed with respect to pipe 8. Installation of male roller 26 in chuck 3 is conventional as it is similar to female rollers (not shown) conventionally employed to impart inwardly projecting grooves in pipes. Roller 26 is driven under power by chuck 3, and roller 24 and pipe 8 rotate passively in response thereto. The rotational axis of chuck 3 and of roller 26 is indicated at R. Rollers 24, 26 are dimensioned and configured to entrap pipe 8 rotatably between roller 24 and roller 26 such that rotation of pipe 8 by chuck 3 progressively forms the outwardly projecting ridge on pipe 8.

Figures 5, 6, 6A:
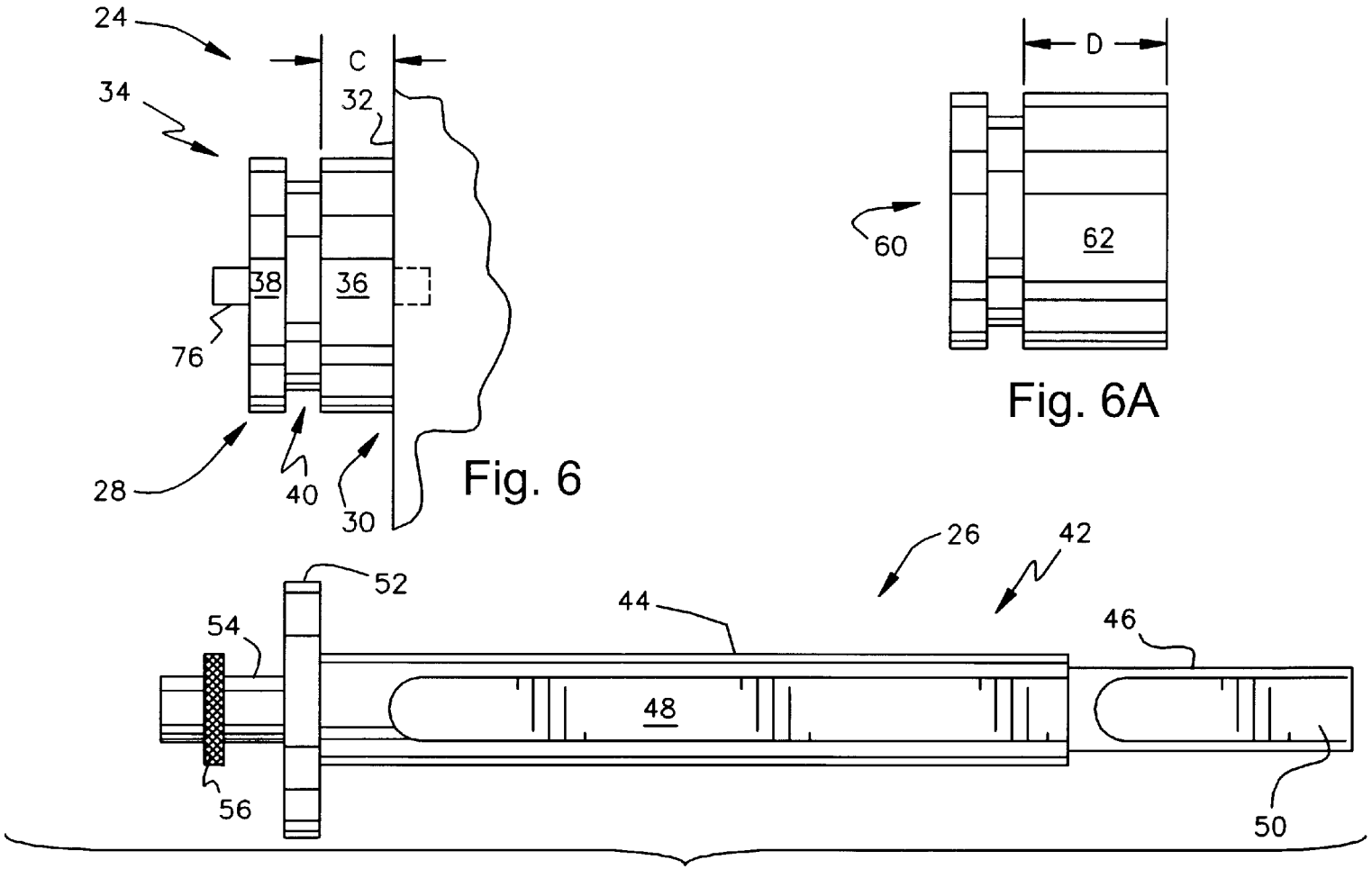
FIG. 5 is a side elevational detail view of the male roller of the invention.
FIG. 6 is a side elevational detail view of the female roller of the invention.
FIG. 6A is a side elevational detail view of a second female roller which optionally replaces the female roller of FIG. 6.

FIGS. 5 and 6 show characteristics of rollers 24, 26. In the depiction of FIGS. 5 and 6, rollers 24 and 26 are shown in their actual axial alignment, but are shown spaced apart from one another for clarity of the view. Female roller 24 has a circumferential surface 28 facing pipe 8 (see also FIG. 4). Roller 24 has a proximal end 30 arranged to abut a surface 32 of tool holder 22, and a distal end 34. Surface 28 bears a first land 36 disposed proximate end 30 and a second land 38 disposed proximate second end 34. A groove 40 is disposed between land 36 and land 38.

Male roller 26 is seen to include a shank 42 having a main section 44 and a turned down section 46. Shank 42 enables roller 26 to be rotatably engageable with chuck 3. Each section 44 or 46 has a flattened facet 48 or 50 (respectively) to engage suitable apparatus (not shown) which prevents ineffectual mutual rotation between roller 26 and chuck 3. Roller 26 has a raised circumferential wall 52 oriented to face pipe 8 (see also FIG. 4) and to face groove 40 of roller 24. A shaft 54 having a knurled roller surface 56 extending circumferentially about shaft 54 projects forwardly of wall 52. Knurled surface 56 prevents ineffectual slippage when working PVC pipe.

Figure 7:
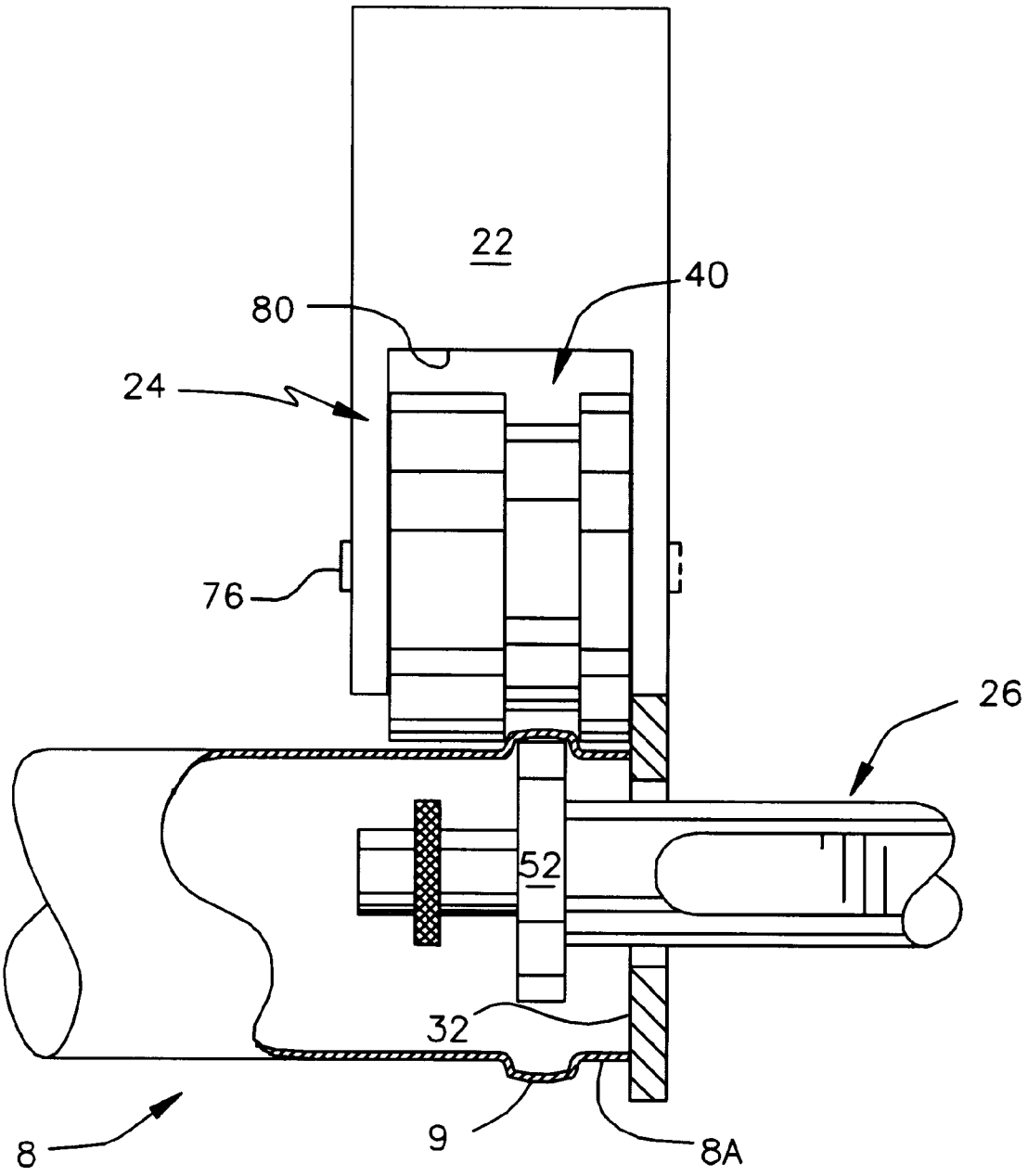
FIG. 7 is an environmental, side elevational view showing a pipe having a ridge formed therein by the novel apparatus, and is shown partially in cross section.

It will be seen in FIG. 6 that land 36 of roller 24 has a predetermined axial length dimension indicated by arrow C. It follows that when roller 24 abuts surface 32 of tool holder 22, groove 40 will be spaced away from surface 32 by a distance equal to the predetermined length. Roller 26 is located in chuck 3 such that groove 40 and wall 52 are in vertical alignment, as seen in FIG. 7. When pipe 8 is fitted between rollers 24 and 26 and pressed into abutment with surface 32 of machine 10, ridge 9 formed by rolling pipe 8 will leave an undisturbed section 8A of pipe 8 between ridge 9 and the right end of the pipe, wherein section 8A is of original diameter. The length of this undisturbed section 8A will correspond to that of dimension C. This feature enables fabrication of many pipes to standardize on a single predetermined dimension of the undisturbed section of pipe.

Magnitude of the undisturbed section of pipe may be modified by employing a second female roller 60, shown in FIG. 6A. Roller 60 is essentially similar to roller 24, except that the predetermined length, which is preferably 0.75 inch, indicated by arrow D of land 62 is greater than that of land 36 of roller 24. Machine 10 can thereby selectively vary location of outwardly projecting ridge 9 with respect to the end of the pipe.

Figure 8:
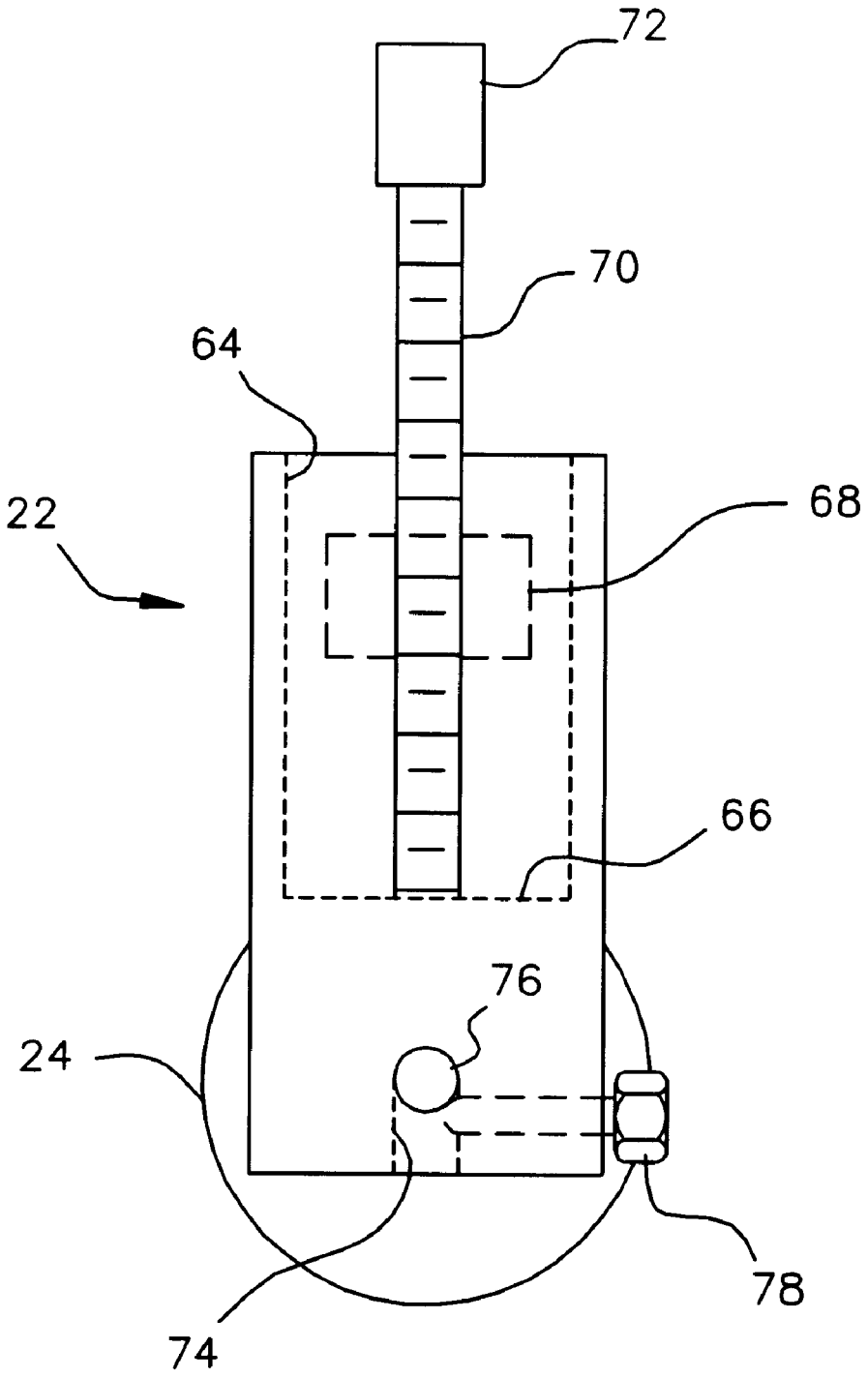
FIG. 8 is a front elevational detail view of the female roller and it supporting frame, seen at the top center of FIG. 1.

Rollers 24 and 60 are removably mounted within tool holder 22. Turning now to FIG. 8, description proceeds with respect to adjustment of female roller 24 to engage the work. Tool holder 22 has an interior cavity 64 having a bottom surface 66. A threaded block 68 solidly fixed to frame 20 projects into cavity 64. A threaded cap screw 70 is threaded into block 68 until it contacts surface 66. Screw 70 has a socket head 72 which is configured to receive the square shank of a ratchet wrench (not shown) or a similar tool enabling screw 70 to be turned under considerable manual force.

When screw 70 is turned so that its lower end moves downwardly and bears against surface 66, roller 24 mounted on tool holder 22 will accordingly be urged downwardly. When chuck 3 is rotated under power, downward pressure imposed on tool holder 22 by screw 70 will progressively form a ridge in the pipe as the pipe wall is forced to conform to configuration of groove 40 of roller 22 and of wall 52 of roller 26 (see FIG. 7). Screw 70 is unthreaded to enable tool holder 22 and roller 24 to disengage from the pipe so that the latter may be removed from machines 2 and 10.

FIG. 8 also shows details of how a female roller 24 or 60 is mounted within tool holder 22. A downwardly open slot 74 is formed in tool holder 22. A cylindrical axle 76 is dimensioned and configured to slide upwardly into slot 74 until being stopped by interference with the upper surface of slot 74. The upper limit of travel of axle 76 is depicted in FIG. 8. Axle 76 is then locked in place by turning a setscrew 78 into engagement with axle 76. Slackening setscrew 78 will, of course, release axle 76 from fixed engagement of tool holder 22 and hence with frame 20.

Tool holder 22 has an open chamber 80 (see FIG. 7) enabling roller 24 to rotate freely therein on axle 76. A roller position adjuster is thereby established by tool holder 22, considered with its slidable mounting on frame 20, screw 70, and block 68. The adjuster is capable of urging rotatably mounted roller 24 selectively towards and away from the axis of rotation of chuck 3, and to selectively impose pressure on roller 24 when a pipe is installed in the chuck such that rollers 24 and 26 forms an outwardly projecting ridge in the pipe.

Novel machine 10 may be modified to form grooves in a pipe rather than outwardly projecting ridge 9. To accomplish this, it is merely necessary to adapt rollers 24 and 26 by exchanging their male and female characteristics. Regardless of whether the rollers are arranged to form grooves or ridges, they are oppositely configured from and correspond to one another. Opposite configuration signifies that one roller is male and the other female. The rollers correspond to one another in that dimensions and configuration of the rollers enable appropriate alignment of lands of one roller and a groove formed in the other roller such that a ridge or groove, as desired, may be formed in a pipe being worked.

It would be possible to modify either socket 14 or 16 or both such that the socket 14 or 16 is not solid about its circumference, having instead a latching arrangement capable of securely encircling its associated tool supporting bar 4 or 5.

It is to be understood that the present invention is not limited to the embodiments described above, but encompasses any and all embodiments within the scope of the following claims.

I claim:

1. A ridge forming machine for forming an outwardly projecting ridge circumferentially on the wall of a pipe, wherein said ridge forming machine is useable with a rotatable chuck of a pipe working machine for working pipes, comprising:

a carriage having attachment elements comprising: a first socket and a second socket disposed to engage the pipe working machine such that said carriage is moveable selectively to an operational position and to a standby position, a frame fixed to said carriage, a tool holder slidably carried on said frame and movable towards and away from the axis of rotation of the chuck, a first roller rotatably mountable on said tool holder such that said first roller rotates on an axis parallel to the axis of rotation of the chuck, and a roller position adjuster disposed to urge said first, rotatable roller selectively towards and away from the axis of rotation of the chuck and to selectively impose pressure on said first roller; and a second roller removably engageable with the rotatable chuck of the pipe working machine and adapted to slidably receive a pipe thereover, wherein said second roller is oppositely configured from and corresponds to said first roller, and wherein said first roller and said second roller are dimensioned and configured to entrap the wall of said pipe therebetween such that rotation of the pipe by said second roller progressively forms the outwardly projecting ridge on the pipe in response to increasing pressure on said first roller from said roller position adjuster, wherein said first roller moves away from the axis of rotation of the chuck when said ridge forming machine is moved from said operational position to said standby position, and wherein said sockets are dimensioned and configured to constrain said carriage against disengagement from the pipe working machine by moving in any direction except a direction parallel to the axis of rotation of the chuck, and enabling said carriage to fully disengage from the pipe working machine by moving only in a direction parallel to the axis of rotation of the chuck.

2. The ridge forming machine according to claim 1, wherein said first roller is a female roller having a circumferential surface facing the pipe and said second roller is a male roller having a raised circumferential wall facing the pipe, said circumferential surface of said female roller has a first end and a second end, and said circumferential surface of said female roller bears a first land disposed proximate said first end, a second land disposed proximate said second end, and a groove disposed between said first land and said second land.

3. The ridge forming machine according to claim 2, wherein said tool holder has an axle disposed to rotatably support said first roller on said frame, and a fastener disposed selectively to secure said axle to said tool holder and to release said axle from fixed engagement of said tool holder.

4. The ridge forming machine according to claim 3, further comprising a female third roller rotatably mountable on said axle of said tool holder, wherein said third roller has a circumferential surface facing the pipe when said third roller is installed on said axle of said tool holder and the pipe is mounted between said second roller and said third roller, wherein said circumferential surface of said third roller has a first end and a second end, and said circumferential surface bears a first land disposed proximate said first end, a second land disposed proximate said second end, and a groove disposed between said first land and said second land, wherein said first land of said first roller has a predetermined length and said first land of said third roller has a predetermined length different from that of said first roller, thereby enabling said ridge forming tool to selectively vary location of said outwardly projecting ridge with respect to the end of the pipe.

5. The ridge forming machine according to claim 1, wherein said first socket has a receptacle dimensioned and configured to slip axially over a first carriage supporting rail formed as part of and projecting from the pipe working machine, wherein said socket includes opposing walls forming said receptacle, wherein distance between said opposing walls is such that said socket encircles and closely cooperates with the carriage supporting rail, and wherein said socket is fully closed and continuous along its circumference.

6. The ridge forming machine according to claim 5, wherein said attachment elements include an open second socket dimensioned and configured to slip radially over and partially encircle a second carriage supporting rail formed as part of and projecting from the pipe working machine when said first socket engages the first carriage supporting rail.

7. The ridge forming machine according to claim 5, wherein said receptacle of said first socket has an interior surface dimensioned and configured to cooperate closely yet slidably with the first carriage supporting rail of the pipe working machine.

8. A pipe working tool having a carriage enabling said pipe working tool to mount to parallel carriage supporting rails of a multipurpose, powered pipe working machine having a chuck, a first carriage supporting rail, a second carriage supporting rail parallel to said first carriage supporting rail, said pipe working tool comprising:

a carriage having a first socket and a second socket, wherein said first socket has a receptacle dimensioned and configured to slip axially over said first carriage supporting rail of the pipe working machine, wherein said socket includes opposing wall faces forming a receptacle having opposing walls defining a substantially rectangular opening in said receptacle, wherein distance between said opposing walls is such that said socket encloses and closely cooperates with the carriage supporting rail, and wherein said socket is fully closed and continuous along its perimeter, and an open second socket having a substantially rectangular cross section and dimensioned and configured to slip radially over and partially surround the second carriage supporting rail of the pipe working machine when said first socket engages the first carriage supporting rail;

a frame fixed to said carriage; and a working element movable mounted on said frame.

* * * * *